US006392538B1

(12) United States Patent
Shere

(10) Patent No.: US 6,392,538 B1
(45) Date of Patent: May 21, 2002

(54) ADVANCED SERVICES INTERACTIVE SECURITY SYSTEM

(76) Inventor: Charles J. Shere, 153 Los Vientos Dr., Newbury Park, CA (US) 91320

( * ) Notice: Subject to any disclaimer, the term of this patent is extended or adjusted under 35 U.S.C. 154(b) by 0 days.

(21) Appl. No.: 08/748,632

(22) Filed: Nov. 13, 1996

Related U.S. Application Data

(60) Provisional application No. 60/006,583, filed on Nov. 13, 1995.

(51) Int. Cl.[7] ..... G08B 1/08

(52) U.S. Cl. ..... 340/539; 340/825.06; 340/690; 340/506; 340/539

(58) Field of Search ..... 340/539, 531, 340/905, 906, 665, 689, 690, 601, 825.06, 286.02, 506; 200/61.45 R; 379/37, 38

(56) References Cited

U.S. PATENT DOCUMENTS

| | | | | | |
|---|---|---|---|---|---|
| 4,153,881 | A | * | 5/1979 | Permut et al. | 340/539 X |
| 5,278,539 | A | * | 1/1994 | Lauterbach et al. | 340/539 |
| 5,489,889 | A | * | 2/1996 | Kambouris et al. | 340/690 |
| 5,568,385 | A | * | 10/1996 | Shelton | 364/420 |
| 5,783,945 | A | * | 7/1998 | Balbachan | 324/38 |

* cited by examiner

*Primary Examiner*—Daryl Pope
(74) *Attorney, Agent, or Firm*—Sughrue Mion, PLLC

(57) ABSTRACT

A security system responds to a notification sent via wireless link to notify the subscriber and also to take some protective action, such as interrupting electric power or shutting off a gas supply. The system is particularly applicable to protecting subscriber premises in the event of an earthquake.

25 Claims, 3 Drawing Sheets

ADVANCED SERVICES INTERACTIVE SECURITY SYSTEM

CROSS REFERENCE TO RELATED APPLICATION

This application is an application filed under 35 U.S.C. §111(a) claiming benefit pursuant to 35 U.S.C. §119(e)(i) of the filing date of the U.S. Provisional Application No. 60/006,583 filed Nov. 13, 1995, pursuant to 35 U.S.C. §111(b).

BACKGROUND OF THE INVENTION

The present invention is directed to security systems, and more particularly to an interactive security system providing advanced services at low cost.

The present invention is further directed to earthquake notification, and more particularly to a system and method for providing notification of impending earthquakes in a manner that maximizes warning time and at the same time initiates safety precautions.

The invention is also directed to a wireless system incorporating an earthquake notification feature, and more generally to wireless security systems.

SUMMARY OF THE INVENTION

In accordance with the present invention, an earthquake notification is sent via wireless link to subscriber homes equipped with wireless receivers, not only notifying the subscriber of an imminent earthquake or other hazard but also effecting other actions, e.g., emergency utility shut-off. The system is also capable of monitoring the status of conditions at the home and communicating those to a subscriber via pager or other such device, and may even include the ability for the subscriber to remotely control certain home security or other functions.

BRIEF DESCRIPTION OF THE DRAWING

The invention will be more clearly understood from the following description in conjunction with the accompanying drawing, in which.

DETAILED DESCRIPTION OF THE INVENTION

Figure 1:
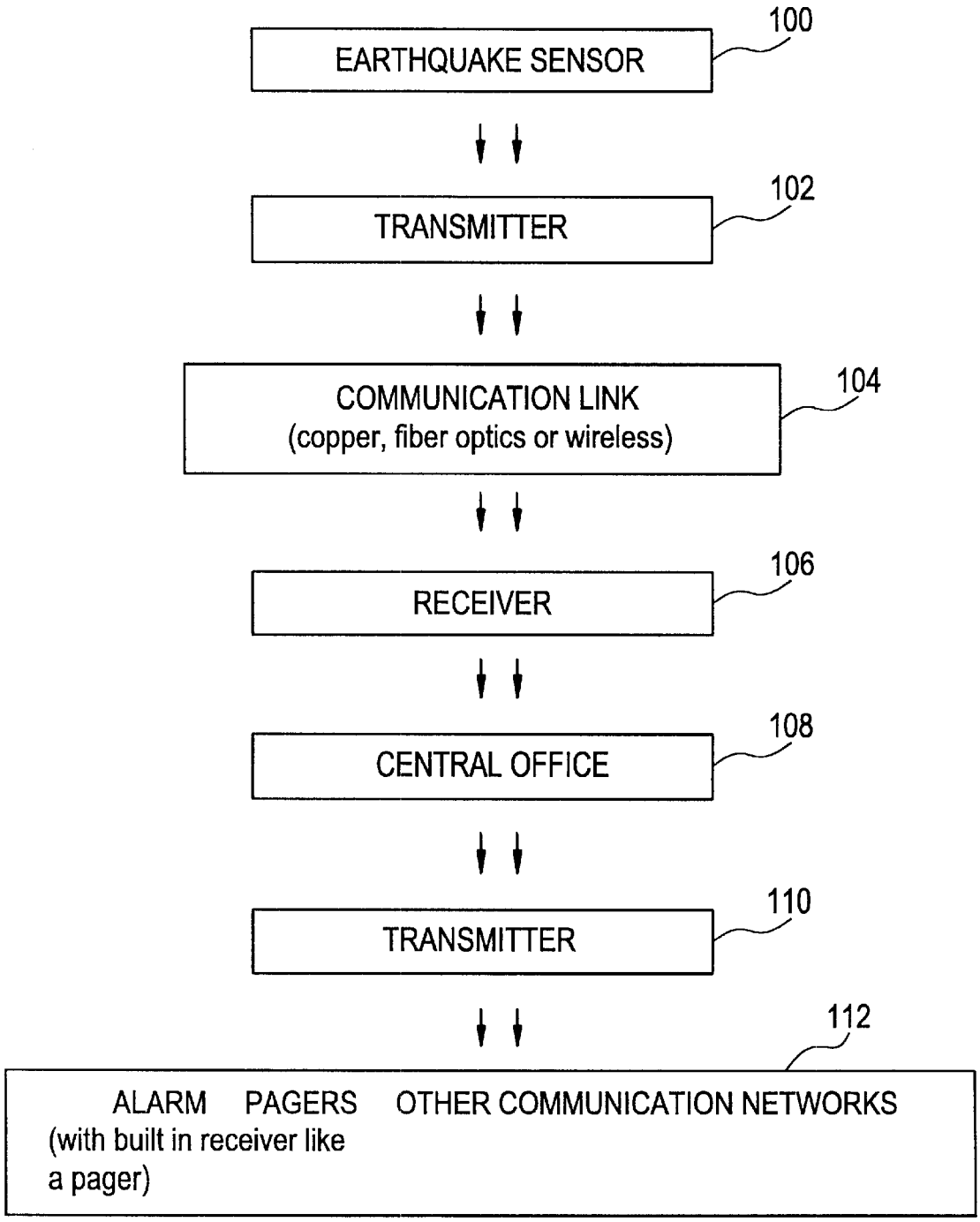
FIG. 1 is a schematic diagram illustrating the design and operation of an earthquake warning system in accordance with the present invention.

FIG. 1 is a schematic diagram of the design and operation of the earthquake notification feature of the present invention. The purpose of such a system would be to give notice prior to an actual earthquake. This would allow people to possibly escape from a dwelling without harm. The system could notify many devices such as pagers and alarm systems. The public could be notified through television, radio or public announcement systems. In short, a device that is connected electronically to a communication network will have the ability to receive this signal.

While a family is asleep at home, a seismic sensor 100 (of a type known in the art) located deep in the earth detects a high magnitude earthquake. The sensor provides an output signal to a transmitting device 102, which transmits via a conventional communications link (or combination of links) 104 to a receiver 106 at or adjacent a central office 108. The central office then broadcasts an earthquake notification signal, e.g., from transmitter 110, which can be picked up by alarm systems (e.g., with a built-in receiver like a pager), pagers, etc. 112. The signal can be relayed to other communication networks if desired.

At home, e.g., an alarm panel (not shown) equipped with a receiver picks up the broadcast message, and activates a siren or other audible alarm signifying an earthquake. The alarm panel provides outputs to automatically disconnect the main gas and electrical sources for prevention of fire. The phone and cable sources are also interrupted to avoid overload. This all takes only seconds, and not only is the home best prepared for an earthquake, but the family has some opportunity to escape from danger.

Lighting in the home may be provided by a battery back-up triggered when the utilities are switched off. After a preprogrammed time limit has expired, the system checks for danger on systems, and switches the utilities back on if all systems appear safe.

Receivers for the notification signal from transmitter 110 can be located at homes, hospitals, schools, government agencies, commercial buildings, industrial buildings, and essentially any place or structure where people would benefit from a warning. The signals could also be used by utilities to interrupt, e.g., the supply of natural gas through pipelines in the effected areas. The signals could even be sent outside the geographic area affected by the earthquake, for informational purposes, although that is ancillary to the broadcast warning function of the invention.

Figure 2:
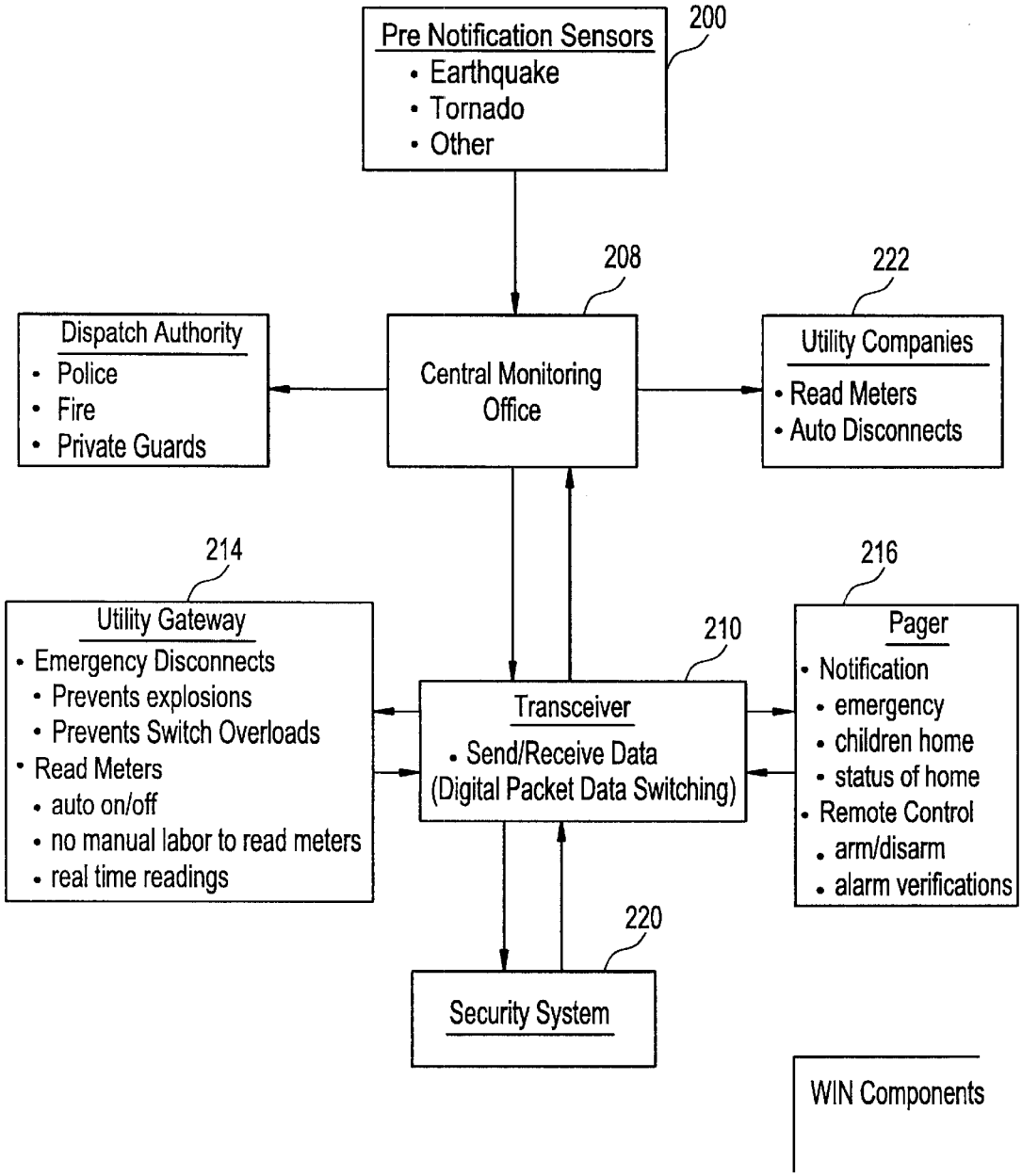
FIG. 2 is a block diagram of an interactive warning and security system in accordance with the invention.

FIG. 2 illustrates an arrangement for a central monitoring system which makes use of the earthquake notification feature described with reference to FIG. 1. As shown in FIG. 2, the sensors 200 may not be limited only to earthquake sensors, but include tornado or other types of sensors. The central monitoring office 208 receives a signal from one such sensor and, via transceiver 210, can implement emergency disconnects through utility gateway 214, can notify a customer via a pager 216, and can notify the home/homeowner as described above with reference to FIG. 1. In addition, the central monitoring office that processes the earthquake notification signal may be the central monitoring office for a monitored security system. Such a central office 208 would then monitor the status of various sensors that are part of the security system 220 in the home, and could dispatch fire, police and/or private guards as appropriate. The central monitoring office could also remotely read utility meters through a utility gateway 214, i.e., a connection box on the side of the home to which the utility lines are run and at which the utility company responsibility typically ends and the customer responsibility begins, and the information can then be relayed to a local utility company 222. Finally, the central office could notify the homeowner of certain conditions via pagers 224. Optionally, the pager could be a two-way device allowing the homeowner to remotely arm and disarm the security system of perform some other functions at the home that are controllable from the central office.

Figure 3:
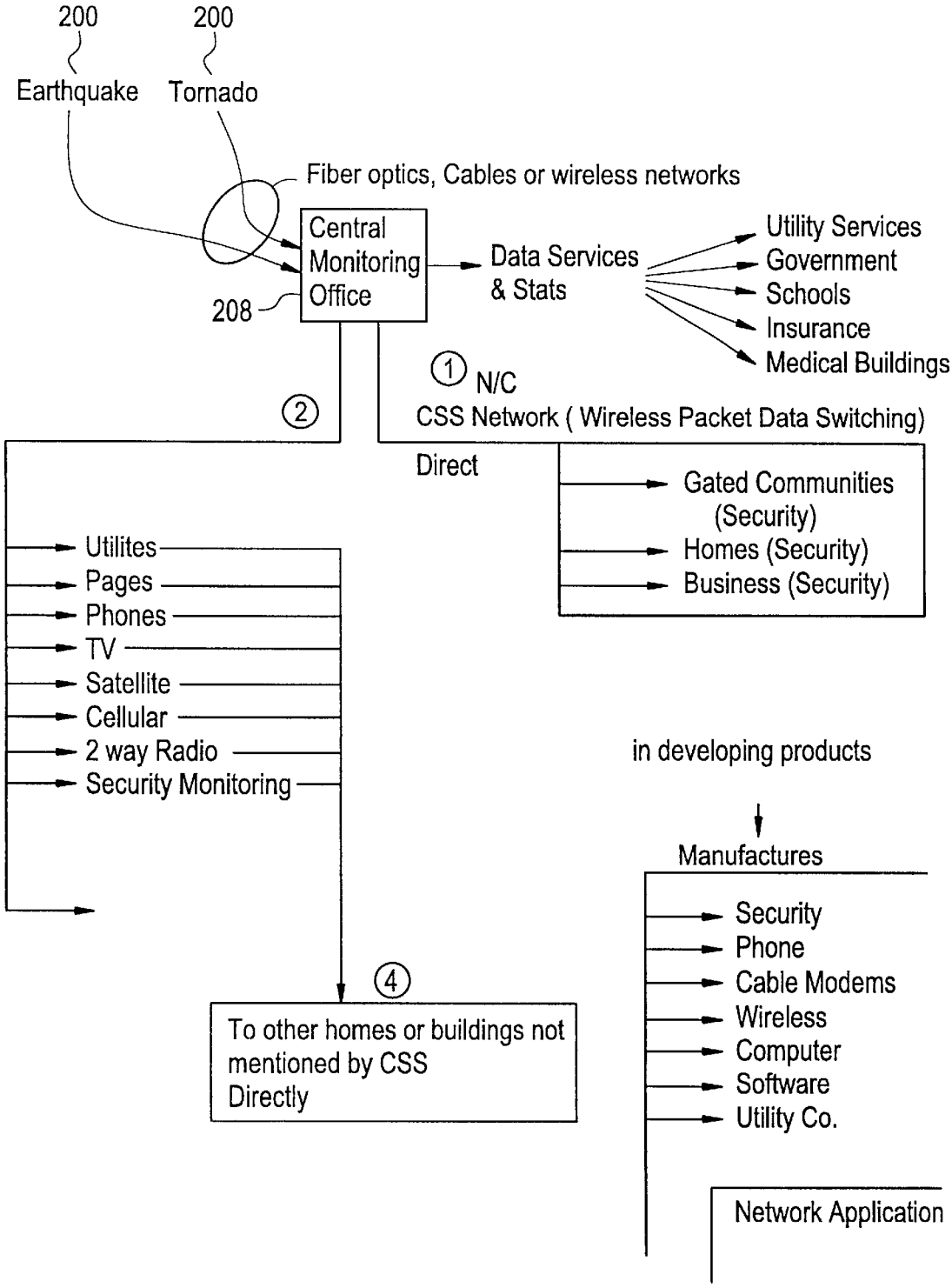
FIG. 3 is a further schematic diagram illustrating further connections and services associated with the system of FIG. 2.

FIG. 3 illustrates the network applications for a wireless interactive network according to the present invention. The sensors 200 may be connected to the central monitoring office 208 via fiber optics, cables or wireless links. The central office 208 can be connected via a wireless link to gated communities, homes, businesses, etc., for monitoring security systems and other on-premises monitoring as described above.

In addition to the two-way communication via wireless link with premises that are monitored directly by the central office, the system may provide for the central office to communicate with other homes, buildings or persons via any number of communications mechanisms, e.g., via utility lines, pagers, phones, television (wireless or cable), satellite, cellular telephone, 2-way radio or via security monitoring link. In some cases this link may be unidirectional, e.g., for warning or notification only, or for utility emergency disconnect, etc., as described above, but it may optionally be bidirectional communications, e.g., as described above for automatic reading of utility meters, allowing remote control of the home security system, etc.

In a security system implemented in accordance with the present invention, the system may control access to a building. Different levels of protection may be achieved through the use of codes, voice recognition, biometrics (e.g., fingerprint readers), etc. The system may be armed through the use of a video phone, which can be conveniently located throughout the home.

The television can be interactive. When security has been breached, the television will have a visual and/or audible indication. The homeowner can then press a button on a remote control or use voice recognition to bring up an image of the security guard on the television screen. The guard can ask for the homeowner's code to verify the alarm, thereby reducing false alarms. The resident will be able to see and hear the security guard, and can talk hands-free. On the other hand, the security guard will not be able to see the resident, although in some cases, e.g., particularly in commercial applications but optionally in residential applications as well, it may be desirable to design the system such that the guard can see inside the home or other guarded premises, e.g., to protect valuables without risk of bodily harm. This can be done through the use of a plug-in module.

Plug-in modules are psychologically beneficial in giving the consumer the feeling of being in control, and are also quite effective from a practical standpoint. Using ports on the television allows the consumer to plug and play various devices such as security, home automation, communications and computers. These devices will link within the home through Power Line Carrier (PLC) based technology or Radio Frequency (RF). These devices will link gateways installed on the building. The gateways will allow various service providers to connect their services to the home, with all gateways being able to interface with one another.

Wireless transmitters, or transceivers, can link homes to a network of transceivers, e.g., mounted on gateways, street lights, traffic signals, etc., with PLC being used to monitor the transceivers and also as a form of back-up in case of failure of transceiver(s) due to vandalism or malfunction. A central office will be able to locate transceivers for immediate repairs. In addition, power companies will use the network as a way to read meters remotely.

Conserving energy is a major focus of the utility industry, and is a significant advantage of the use of data networks by power companies. Such networks would provide real time cost analysis of appliances in the home, helpful in the scheduling of appliance usage. This would help to prevent the "domino" effect where an overload at one power will cause an outage, the load is then transferred to another power company, and outage occurs there, and so forth.

Power companies can cut down on demand by notifying customers of peak times, the notification being given in real time through a data network tied into gateways that link to the appliances themselves. This gives the ability for the power company to offer services that will conserve energy while also allowing consumers the ability to program devices automatically not to come on in these peak times, thereby saving money for the consumer.

The data network can offer security for such things as security automation, communication and notification. Communications through the network of the present invention include communications ancillary to security systems and two-way pagers, the latter sending and receiving information relating to alarms, children arriving home and earthquake prewarning. The prewarning system can link gateways and allow utilities to electronically disconnect to prevent explosions and switch overloads. After a quake, a sensor linked to the gateway will transmit a true seismic reading from the individual buildings to the central office creating a powerful database. This database will direct emergency response teams to the areas hardest hit and provide insurance companies with a way to reduce insurance fraud, e.g., by determining the exact impact strength of the quake at each residence, making it more difficult for persons to make exaggerated claims.

The system can be implemented in all public and government agencies, including schools and hospitals at no charge, required in new construction by the uniform building code and offered with a discount on insurance policies for all buildings that use it.

While specific embodiments of the invention have been described above, it will be appreciated that various changes and modifications may be made without departing from the spirit and scope of the invention as defined in the appended claims.

I claim:

1. A security system, comprising:

an earthquake sensor for detecting a predetermined condition;

a central office;

a communications link for notifying said central office of the existence of said predetermined condition;

a transmitter at said central office responsive to the existence of said predetermined condition for transmitting a notification signal to at least one receiver; and control means associated with said at least one receiver for initiating a control function in response to said notification signal.

2. A security system according to claim 1, wherein said control function comprises changing an ON/OFF state of a device which controls at least one non-audible protection function.

3. A security system according to claim 1, wherein said control function comprises activating an alarm.

4. A security system according to claim 1, wherein said notification signal is transmitted simultaneously to a plurality of receivers.

5. A security system according to claim 1, wherein said control function comprises changing an ON/OFF state of a device which is ordinarily used for purposes other than alarm/notification.

6. A security system according to claim 1, wherein said device comprise a television set.

7. A security system for protecting a secured premises, comprising:

a sensor for detecting a predetermined condition;

a central office;

a communications link for notifying said central office of the existence of said predetermined condition;

a transmitter at said central office responsive to the existence of said predetermined condition for transmitting a notification signal to at least one mobile receiver remote from said secured premises; and control means associated with said at least one receiver for initiating a control function in response to said notification signal, wherein said control function comprises providing an audible alarm to a user of said mobile receiver.

8. A security system for a premises, comprising:

a sensor at said premises for detecting a predetermined seismic condition and providing a detection output;

a transmitter at said premises responsive to said detection output for transmitting seismic information to a central office:

a transmitter at said central office for transmitting a control signal to said premises; and a controller at said premises, said controller initiating a control function in response to said control signal.

9. A security system, comprising:

a sensor for detecting a predetermined condition;

a central office;

a communications link for notifying said central office of the existence of said predetermined condition;

a transmitter at said central office responsive to the existence of said predetermined condition for transmitting a notification signal to at least one receiver; and control means associated with said at least one receiver for initiating a control function in response to said notification signal, wherein said control function comprises interrupting a utility service.

10. A security system according to claim 9, wherein said control function comprises interrupting a supply of electricity.

11. A security system according to claim 9, wherein said utility service is a supply of power.

12. A security system according to claim 9, wherein said transmitter transmits said notification signal to a plurality of receivers each associated with at least one customer, and wherein said control function comprises interrupting the supply of said utility to a plurality of customers.

13. A security system for a premises, comprising:

a sensor for detecting a predetermined seismic condition and providing a detection output;

a transmitter responsive to said detection output for transmitting a notification signal to at least one receiver associated with a utility company; and a controller at said premises, said controller initiating a control function in response to said detection output; wherein said control function comprises interrupting the supply of said utility.

14. A security system according to claim 13, wherein said control function comprises activating an alarm.

15. A security system according to claim 13, wherein said control function comprises interrupting a supply of power.

16. A security system according to claim 13, wherein said control function comprises changing an ON/OFF state of a device.

17. A security system, comprising:

at least one controllable element at a premises for interrupting a utility service when activated;

at least one receiver at said premises for receiving from a remote location a signal representative of a predetermined condition; and a controller which activates said controllable element in response to reception of said signal by said receiver.

18. A system according to claim 17, wherein said utility is electric power.

19. A system according to claim 17, wherein said utility is gas.

20. A system according to claim 17, wherein said system automatically resets said controllable element in accordance with predetermined criteria.

21. A system according to claim 17, wherein said signal is broadcast from a central office to a plurality of premises.

22. A security system for a premises, comprising:

a sensor for detecting a predetermined seismic condition and providing a detection output;

a controller at said premises, said controller initiating a control function in response to said detection output; and a transmitter at said premises for transmitting seismic information to a central office.

23. A security system for a premises, comprising:

a sensor for detecting a predetermined seismic condition and providing a detection output;

a controller at said premises, said controller initiating a control function in response to said detection output;

a central office;

a communications link for notifying said central office of the existence of said predetermined seismic condition; and a transmitter at said central office responsive to the existence of said predetermined condition for transmitting a notification signal to a receiver at said premises.

24. A security system, comprising:

at least one controllable element at a premises for implementing a control function when activated;

at least one receiver at said premises for receiving from a remote location a signal representative of a predetermined seismic condition; and a controller which activates said controllable element in response to reception of said signal by said receiver.

25. A system according to claim 24, wherein said signal is broadcast from a central office to a plurality of premises.

* * * * *